US010804092B2

(12) United States Patent
Riedel et al.

(10) Patent No.: US 10,804,092 B2
(45) Date of Patent: Oct. 13, 2020

(54) ANALYSIS DEVICE FOR GASEOUS SAMPLES AND METHOD FOR VERIFICATION OF ANALYTES IN A GAS

(71) Applicant: Bundesrepublik Deutschland, Vertreten Durch Den Bundesminister Für Wirtschaft Und Energie, Berlin (DE)

(72) Inventors: Jens Riedel, Berlin (DE); Andreas Bierstedt, Berlin (DE)

(73) Assignee: Bundesrepublik Deutschland, Vertreten Durch Den Bundesminister Für Wirtschaft Und Energie, Berlin (DE)

( * ) Notice: Subject to any disclaimer, the term of this patent is extended or adjusted under 35 U.S.C. 154(b) by 0 days.

(21) Appl. No.: 16/319,925

(22) PCT Filed: Jul. 25, 2017

(86) PCT No.: PCT/EP2017/068778
§ 371 (c)(1),
(2) Date: Jan. 23, 2019

(87) PCT Pub. No.: WO2018/019837
PCT Pub. Date: Feb. 1, 2018

(65) Prior Publication Data

US 2019/0267225 A1 Aug. 29, 2019

(30) Foreign Application Priority Data

Jul. 26, 2016 (DE) ..... 10 2016 113 771

(51) Int. Cl.
*H01J 49/16* (2006.01)
*H01J 49/00* (2006.01)
*H01J 49/04* (2006.01)

(52) U.S. Cl.
CPC ..... *H01J 49/162* (2013.01); *H01J 49/0072* (2013.01); *H01J 49/0422* (2013.01)

(58) Field of Classification Search
CPC ..... H01J 49/0422; H01J 49/162; H01J 49/26; H01J 49/10; H01J 49/145; H01J 49/161
See application file for complete search history.

(56) References Cited

U.S. PATENT DOCUMENTS 5,164,592 A * 11/1992 Kitamori ..... H01J 49/164 250/281
7,910,883 B2 3/2011 Muehlberger et al.
2012/0099103 A1* 4/2012 Hahn ..... G01N 21/718 356/316

FOREIGN PATENT DOCUMENTS

DE 3619886 A1 12/1986
DE 69031062 T2 2/1998
(Continued)

OTHER PUBLICATIONS

Peng et al., 'High-Pressure Gas Phase Femtosecod Laser Ionization Mass Spectrometry' May 30, 2012, Anal Chem 84, 5633-5640.*
(Continued)

*Primary Examiner* — Eliza W Osenbaugh-Stewart
(74) *Attorney, Agent, or Firm* — Bachman and LaPointe PC; George Coury

(57) ABSTRACT

An analysis device for a gaseous sample includes a mass spectrometer (6) having a measurement chamber and an inlet (5) leading into the measurement chamber, and a laser irradiation unit (30, 3). The analysis device is designed to convey the gaseous sample to the inlet by a flow including the gaseous sample. The laser irradiation unit (30, 3) is designed to ignite a plasma (1) by a laser beam (2') in the flow (4).

17 Claims, 9 Drawing Sheets

(56) References Cited

FOREIGN PATENT DOCUMENTS

| | | | |
|---|---|---|---|
| DE | 19820626 | A1 | 11/1999 |
| DE | 10002970 | A1 | 8/2001 |
| DE | 112012005173 | T5 | 8/2014 |
| GB | 2434250 | A | 7/2007 |
| JP | 2007315847 | A | 12/2007 |

OTHER PUBLICATIONS

International search report for patent application No. PCT/EP2017/068778 dated Oct. 4, 2017.

* cited by examiner

ANALYSIS DEVICE FOR GASEOUS SAMPLES AND METHOD FOR VERIFICATION OF ANALYTES IN A GAS

BACKGROUND OF THE INVENTION

The present invention relates to an analysis device for gaseous samples, in particular an analysis device having a mass spectrometer, and to a method for detecting analytes in a gas, in particular gaseous and particulate analytes in a gas.

Mass spectrometry, in which the mass-to-charge ratios (m/z) of atoms or molecules are determined, is widely used for high-resolution characterization of chemical compounds. For example, mass spectrometry may be used in environmental analysis, in biomedical and pharmacological testing, technical criminal investigations, and in doping controls, to name just a few fields of application.

Mass-spectrometry testing is at first based on the transfer of the analytes to be detected into the gas phase, as well as subsequent ionization. A plasma may be used for this. In inductively coupled plasma mass spectrometry (ICP-MS), which is frequently used in analytics, plasma torches are used to ionize the sample. Plasma torches are very large, however, consume a great deal of current and process gas, and are also very slow due to lengthy cycle times. Therefore inductively coupled plasma usually needs a few seconds to minutes until it is running in a stable manner.

In the LAMMA (laser microprobe mass analysis) and LIMS (laser ionization mass spectrometry) methods, a laser is used for sampling the solid directly. This results in the formation of a laser plasma directly on a microsample. Biological samples, inter alia, may be tested using LAMMA, as well. However, LAMMA is not suitable for gaseous samples, but instead is limited to solid microprobes that have typical volumes of approximately 1 μL and that must also be present and stable in the vacuum. The microprobe must therefore be added to and discharged from the vacuum system of the measuring instrument before and after each measurement.

SUMMARY OF THE INVENTION

In view of the above, the present invention suggests an analysis device, a method, and a use as disclosed herein.

According to an embodiment, an analysis device for a gaseous sample includes a mass spectrometer having a measurement chamber and an inlet leading into the measurement chamber, and a laser irradiation unit. The analysis device is designed to convey the gaseous sample to the inlet of the mass spectrometer by means of a flow comprising the gaseous sample. The laser irradiation unit is designed to ignite a plasma with a laser beam in the flow upstream of the inlet of the mass spectrometer to at least partly ionize the gaseous sample.

An inner cross-section of the inlet of the mass spectrometer may enlarge, at least by section, towards the measurement chamber. An inner diameter of the inlet of the mass spectrometer typically tapers outward (enlarges towards the measurement chamber), typically by a factor of at least 10, more typically by a factor of at least 20. The inner diameter may taper outward monotonically, or even strictly monotonically. The inlet of the mass spectrometer may in particular be designed as a nozzle tapering outward, typically having an inner diameter on the side facing away from the measurement chamber of less than 500 μm, more typically less than 250 μm, or even 200 μm. For technical reasons of flow and vacuum, such an inlet has proved particularly well suited for mass spectroscopic testing.

The laser irradiation unit typically includes a laser and/or a focusing optical unit for focusing the laser beam in the flow.

In addition, the laser irradiation unit is typically arranged, at least in part, in a flow direction upstream of the inlet.

The laser is typically a pulsed laser, i.e., a laser that may be operated in pulsed operation. Particularly high laser output may be attained with pulsed lasers, whose peak pulse power is typically in a range from 10 kW to 1 MW, and which thus can produce plasma of an appropriately high temperature in the gas flow upstream of the mass spectrometer.

For example, the laser may be a pumped solid-state laser that can emit laser pulses in the visible or near infrared. It is possible to use a pulsed UV laser; however, plasmas that lead to good atomization and/or ionization of analytes contained in the carrier gas may also be produced with longer-wave (and thus less complex) pulsed lasers.

The analytes do not have to be fragmented using direct laser excitation.

The pulse rate of the laser may typically be in a range of 50 Hz to 1 MHz, in particular in a range of 1 kHz to 1 MHz.

Instead of one laser, it is also possible to use two or even more lasers whose laser beams may cross in the flow during operation.

The analyte or analytes may be dispersed in the carrier gas, typically in the form of nanoparticles or microparticles, e.g. as air-borne aerosols, or may be mixed in gaseous form with the carrier gas. In addition, the carrier gas, which may be, e.g. nitrogen or air, may be mixed with a chemically inert process gas such as argon. However, the carrier gas may also itself be a noble gas, e.g. argon.

A plasma may be ignited in the carrier gas or in the mixture of the carrier gas and the process gas by means of the laser beam. This typically occurs in a contactless manner, i.e., not on macroscopic surfaces, e.g. metal surfaces.

In this way it is possible to prevent material that has been removed from the surfaces from influencing the subsequent mass-spectroscopic analysis (impurity or cross-contamination). Chemical impairment of the analysis results may also at least largely be prevented by a high proportion of noble gases in the flow.

The laser irradiation unit is typically calibrated to the mass-spectrometer such that, in operation, the laser can produce a focus in the flow that is sufficiently spaced apart from macroscopic surfaces. This distance between the focus and the macroscopic surfaces is typically greater than 1 mm or even 1 cm.

The term "macroscopic surface" as used herein shall be construed to be a surface that has in at least in one direction an extension that is greater than 0.1 mm, more typically greater than 1 mm.

The plasma ignited by the laser has a high temperature of typically greater than 1000° K or even greater than 5000° K, more typically greater than 10000° K or even greater than 15000° K.

Compared to the inductively coupled plasma, a laser plasma may have a higher temperature (and thus greater ionization efficiency), better efficiency in its production, as well as a scalable size of a few micrometers to a few centimeters.

The plasma thus has sufficient internal energy, charge, and radiation to break the chemical and physical bonds in the analyte molecule assemblies. After complete dissociation, additional excess plasma energy may lead to a charge transfer to the analyte atoms produced. These may then be moved with the flow via the inlet into the vacuum region (i.e. a region of negative pressure having a gas pressure below 300 mbar) of the measurement chamber of the mass spectrometer and analyzed there.

It is not necessary to directly fragment the analytes into atoms and ions using the laser, e.g. using multi-photon absorption. Therefore, the laser does not have to be adjusted to the analytes.

In addition, it has been found that plasmas that are ignited in the gas phase may be significantly more stable and may be maintained without direct contact to the sample.

When the parameters laser power, pulse rate, and flow speed are selected appropriately, it is also possible for the ionization to occur without prior atomization of the analyte. Thus the analysis device may be configured both for element analysis and for molecule analysis.

Typically the flow is produced, or even controlled, via the mass spectrometer, which is typically a time-of-flight mass spectrometer. To this end, the mass spectrometer typically includes a suction pump so that the gaseous sample may be sucked through the inlet into the measurement chamber. The suction pump may be a vacuum pump. In addition, the mass spectrometer typically includes suitable electrostatic filters and lenses (ion optics elements) that permit the transfer of ions produced under atmospheric pressure into the measurement chamber.

The plasma may therefore occur in the flow at atmospheric pressure or a slight negative pressure, e.g. in a pressure range of approximately $10^4$ Pa to approximately $10^5$ Pa, especially greater than $4*10^4$ Pa or even $5*10^4$ Pa. Since separate vacuum technology is not necessary, the structure of the analysis device may be comparatively simple and/or cost effective.

The chosen design of the analysis device allows a lower gas consumption and/or a lower power consumption compared to the ICP-MS with a comparable or even higher ionization efficiency. In addition, rapidly turning the plasma on and off is made possible, so that the plasma may be better adapted to the actual sample (entry). All this may have a positive effect on the detection limits for analytes in gases. In addition, the analysis device may be relatively compact.

In addition, existing mass spectrometers may be easily retrofitted. A corresponding retrofitting kit for mass spectrometers therefore includes at least one laser irradiation unit and one set of assembly instructions. In addition, the retrofitting kit may include a data cable that can be connected to the laser irradiation unit and the mass spectrometer and/or may include a data carrier having program instructions adapted to cause a processor of the mass spectrometer to send control commands to the laser irradiation unit. In addition, the retrofitting kit may include the other components of the analysis device described in the following, in particular fluidic components.

In one exemplary embodiment, the analysis device includes the mass spectrometer and a laser irradiation unit that is designed to produce a plasma in a flow leading into the measurement chamber upstream of the inlet of the mass spectrometer. For example, the laser beam (during operation) may be focused on a point upstream of the inlet (in the flow direction) that is located at a distance of approximately 1 mm to approximately 5 cm, typically a distance of approximately 2 mm to approximately 1 cm, upstream (in front) of the inlet.

The analysis device may include a separate evaluation unit that is connected to the mass spectrometer and the laser irradiation device and controls them (as master). Control of the analysis device may also be provided by a controller of the mass spectrometer or the laser irradiation unit, however.

According to one development, the analysis device includes a gas supply that is for the gaseous sample and that is arranged upstream of the inlet. This allows the gaseous sample to be guided in a defined manner into the plasma generation area (by the laser).

The gas supply may have a fluid channel for the gaseous sample, e.g. a hose and/or a tube, in particular a glass capillary, or may be formed by the fluid channel. In addition, the gas supply may also have a pressure pump for adjusting the flow rate for the gaseous sample through the fluid channel.

The gas supply may also occur via a mixing cell having a first inlet for the gaseous sample, a second inlet for a process gas such as argon, which inlets typically lead into e.g. a tubular mixing chamber, and with an outlet for a mixed gas formed from the gaseous sample and the process gas. The outlet may be formed by one end of the mixing chamber. The gaseous sample may be mixed into the chemically inert process gas in a defined manner by means of the mixing cell. To this end another pressure pump may be provided and arranged upstream of the second inlet and connected thereto.

In order to counteract the cooling of the plasma by collisions with the cold process gas flowing downstream, the process gas can be preheated (thermally excited) and/or electronically excited (e.g. pre-ionized).

Therefore a heating cell and/or discharge cell may be provided for the process gas upstream of the mixing cell.

According to one development, the analysis device has a plasma cell, in which the laser can ignite the plasma in the flow, which is fluidically connected to the gas supply and the inlet, typically even in a gas-tight/hermetically sealed manner. The plasma cell is also called the plasma chamber in the following.

Typically the plasma cell has a larger inner diameter, in a radial direction which is perpendicular to the direction of the flow, than the mixing cell and/or a fluidic connection, e.g. a tube connection or glass capillary, arranged between the plasma cell and the inlet.

In this way the flow may flow through the plasma cell such that the flow is spaced apart in radial directions from a wall of the plasma cell. Thus undesired interactions between the plasma and the wall of the plasma cell, and therefore resultant impurities and cross-contaminations, may be at least largely prevented.

Surprisingly, when the plasma cell is used, a significantly higher proportion of the analytes can be atomized and the atoms formed during atomization ionized. This leads to increased measurement sensitivity in the subsequent analysis in the mass spectrometer. The higher efficiency of the fragmentation of the analytes in the plasma cell compared to laser-induced plasma fragmentation in the free gas flow mainly results from the fact that the analytes travel into hotter plasma areas. With suitable parameter settings (laser power and flow velocity), at least almost complete atomization and subsequent ionization of the atoms formed during atomization can be achieved in the plasma chamber.

On the other hand, if the plasma fragmentation caused by the laser occurs in the free gas flow, not all of the analytes flow through the hottest plasma regions, but instead may be deflected by compression waves proceeding from the laser focus into cooler plasma regions in which the analytes are ionized via indirect mechanisms and are not atomized. This mode of operation may also be desired.

However, compared to igniting the plasma on a liquid or solid electrode or other solid body, igniting the plasma in the gas itself—regardless of whether this occurs in a free flow or in the plasma cell—nevertheless has the advantage that no material that contaminates the measurement is released by the plasma. In addition, regular replacement of the electrode or solid body is not necessary. Moreover, plasmas that are ignited on the surfaces of solid bodies are subject to strong pulse-to-pulse fluctuations, since the pulses are preferably ignited at stochastically distributed surface defects.

The plasma cell typically has an inner diameter in radial directions that is larger by a factor of 1.5 to 5, typically by a factor of 2 to 4, than the mixing cell and/or the fluidic connection.

According to an embodiment, a pulsed laser is used for igniting a plasma in a carrier gas of a gaseous sample before the gaseous sample is analyzed in a mass spectrometer for gaseous analytes present in the gaseous sample and/or analytes present in the carrier gas as dispersed aerosol particles and/or analytes present in dispersed aerosol particles.

According to an embodiment, a method for analyzing a gaseous sample includes producing a flow, which includes the gaseous sample, leading into a mass spectrometer, typically a time-of-flight mass spectrometer, and igniting a plasma in the flow with a laser beam.

The flow may be formed by the gaseous sample.

However, it is also possible to mix the gaseous sample with a process gas prior to igniting the plasma. In this embodiment, the plasma is ignited by the laser in the flow formed by the mixture of gaseous sample and process gas.

Since the gaseous sample typically includes a carrier gas and an analyte, wherein the analyte may be dispersed in the carrier gas or may be mixed with the carrier gas, the plasma is typically ignited by the laser in the carrier gas, the process gas, and/or a mixture of the carrier gas and the process gas.

The plasma is typically ignited repetitively with the laser beam.

In addition, the plasma is typically ignited in a contactless manner, i.e., directly in the gas and not on a surface of a solid or liquid (macroscopic) body.

Prior to mixing, the process gas may be excited thermally and/or electronically. In particular the process gas may be heated. In addition, the process gas may be subjected to electrical discharges, typically partially ionized.

The plasma is typically produced such that the temperature of the plasma is greater than 1000° K, greater than 5000° K, greater than 10000° K, or even greater than 15000° K.

Depending on the selection of the parameters laser power (pulse peak power), laser pulse rate, flow composition, and the presence or absence of radial limitation of the flow in the region where the plasma is ignited with the laser, at least nearly complete atomization of the analyte and subsequent ionization of the atoms formed during the atomization may take place, or even at least nearly complete ionization of the (non-atomized) analytes may take place.

Once the plasma-treated flow has been conducted into the mass spectrometer, testing for analytes, detection of analytes, or even their quantification may take place.

The embodiments described in the foregoing may be combined with one another as desired.

Additional advantageous embodiments, details, aspects, and features of the present invention result from the dependent claims, the description, and the attached drawings.

BRIEF DESCRIPTION OF THE DRAWINGS

In the figures, identical reference numbers refer to similar parts.

DETAILED DESCRIPTION

Figure 1A:
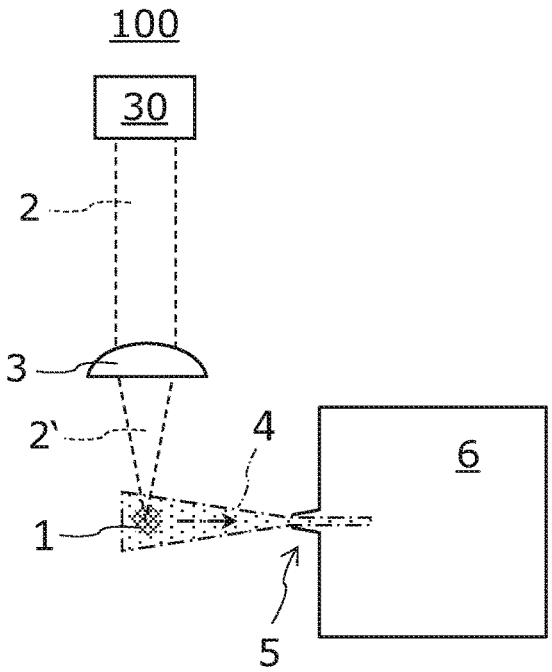
FIG. 1A is a schematic illustration of an analysis device for gaseous samples according to an embodiment.

FIG. 1A is a schematic illustration of an analysis device 100 for gaseous samples. The analysis device 100 includes a mass spectrometer 6 and a laser irradiation unit that has a laser 30 and a focusing optical unit depicted as a lens 3. The mass spectrometer 6 has an inner measurement chamber and an inlet 5 leading into the measurement chamber. For sake of clarity, no detailed illustration of the structure of the mass spectrometer 6, laser 30, and focusing optical unit 3 is provided.

The experimental results presented below were determined with an API-HTOF MS time-of-flight mass spectrometer (Tofwerk, Thun, Switzerland) for the mass spectrometer 6 and a Conqueror 3-LAMBDA laser (Compact Laser Solutions GmbH, Berlin, Germany), i.e., a diode-pumped Nd:YVO4 laser for the laser 30, wherein the wavelength of the laser beams used was $\lambda$=532 nm. The API-HTOF MS time-of-flight mass spectrometer has internal pumps (three pump stages) with which gas may be drawn in via the inlet 5. As is illustrated in FIG. 1A, the time-of-flight mass spectrometer used is provided with a specially produced metal inlet 5 that tapers conically outward. On the side facing atmospheric pressure, the inlet 5 has an inner diameter, for example, of 150 μm. This diameter increases uniformly towards the measurement chamber (vacuum region) of the mass spectrometer 6 to, for example, 4 mm, with a total length, for example, of 15 mm. The exemplary used focusing optical unit for the laser includes three Nd:YAG laser mirrors (NB1-K13, Thorlabs, Dachau, Germany) and an aspherical lens (C240TME-A, Thorlabs, Dachau, Germany) with a numerical aperture of NA=0.50 and a focal length off=8 mm Comparable results may also be obtained with other mass spectrometers and/or sufficiently powerful laser irradiation units.

In the exemplary embodiment, the mass spectrometer 6 may produce from ambient air a flow 4 leading through the inlet 5 into the measurement chamber. The direction of the flow 4 is indicated by the arrow. In addition, the laser 30 may emit a laser beam 2 that, after leaving the focusing optical unit 3, forms a laser focus in the flow 4 as a focused laser beam 2'. The laser focus may ignite a plasma 1 in the flow 4.

Using the plasma 1, components of the air, and in particular analytes present in the air, typically airborne analytes in the form of molecules in the gas phase or in the form of liquid or solid particles as aerosol, are converted, at least in part, to ions and/or elementary ions (ions of the atoms the molecules are made of).

In the case of solid or liquid aerosol particles, these are initially evaporated in the laser-induced plasma 1, so that molecules of the analyte are converted into the gas phase. The molecules in the gas phase may be atomized in the plasma 1, i.e., the chemical bonds may be broken. The resultant atoms may be ionized in the plasma 1, i.e., may be transferred into charged particles. These steps may occur either simultaneously or sequentially in the plasma 1.

The temperatures in the plasma 1 may reach up to several thousand degrees Kelvin.

After decomposition of the analytes into ions or elementary ions, they and any reaction products that have been created may be analyzed in the mass spectrometer 6.

Figure 1B:
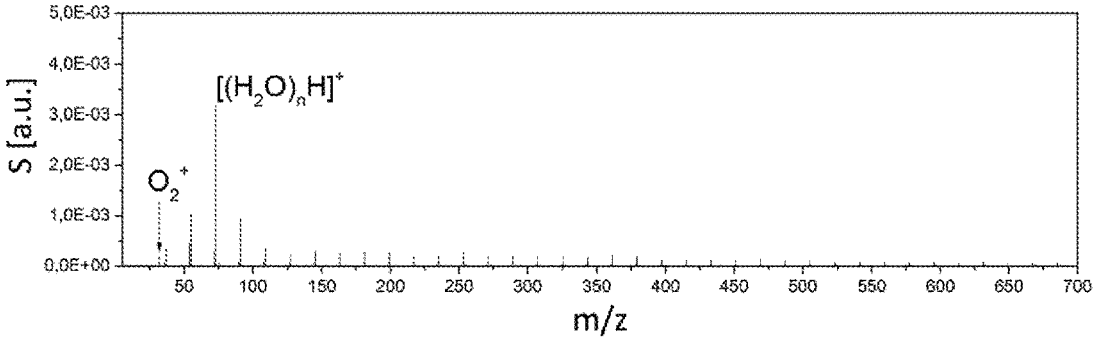
FIG. 1B shows a mass spectrogram determined by means of the analysis device illustrated in FIG. 1A.
Figure 1C:
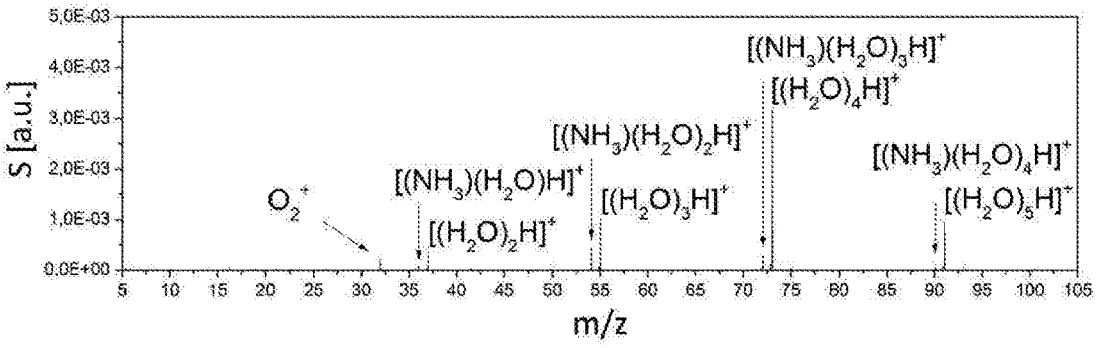
FIG. 1C shows a mass spectrogram determined by means of the analysis device depicted in FIG. 1A.

FIG. 1B depicts a mass spectrogram of ambient air determined with the analysis device 100 illustrated in FIG. 1A. For this, a flow 4 leading into the measurement chamber was produced by the mass spectrometer 6, the laser beam 2, 2' was focused on a point located approximately 2 mm upstream of the inlet 5, and the laser 30 was operated in pulsed mode. FIG. 1C illustrates a portion of the mass spectrograph shown in FIG. 1A with higher resolution.

As is common in mass spectrometry, in the mass spectrograms, hereinafter also referred to as spectrograms for short, the relative frequency S is depicted in arbitrary units (a.u.) of detected charged objects as a function of the dimensionless measure m/z, which is inversely proportional to the (absolute) specific charge (absolute charge per mass).

The illustrated spectrograms are consistent with expected spectrograms for ambient air in the absence of analytes. The reactive species detected here also represent three possible ionization paths of an analyte or analyte group (analyte residue) M as a function of its chemical properties: (1) development of protonated species M+H+, (2) Ammonium adduct formation M+NH4+, and development of radical cations M+. The symbol "+" denotes the positive charge of the cations.

Moreover, additional mechanisms, such as impacts with electrons, photoionization via UV photons, thermal ionization, and Penning ionization may be considered as possible ionization paths.

Figure 2A:
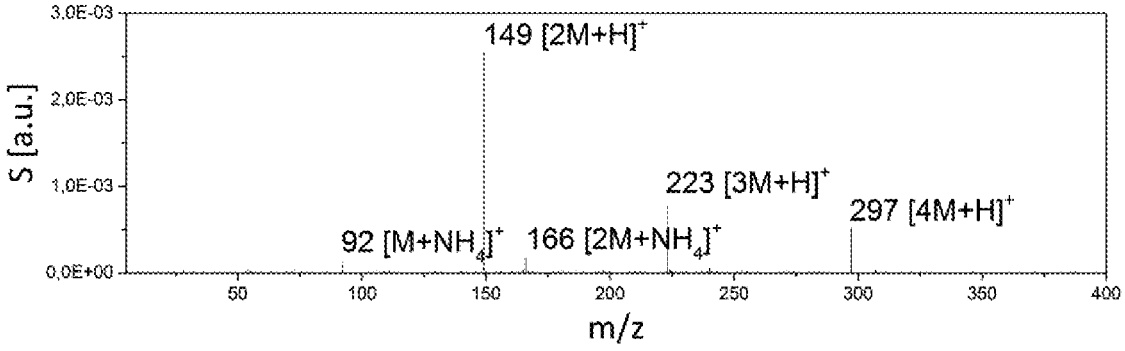
FIG. 2A shows a mass spectrogram determined by means of the analysis device illustrated in FIG. 1A.
Figure 2B:
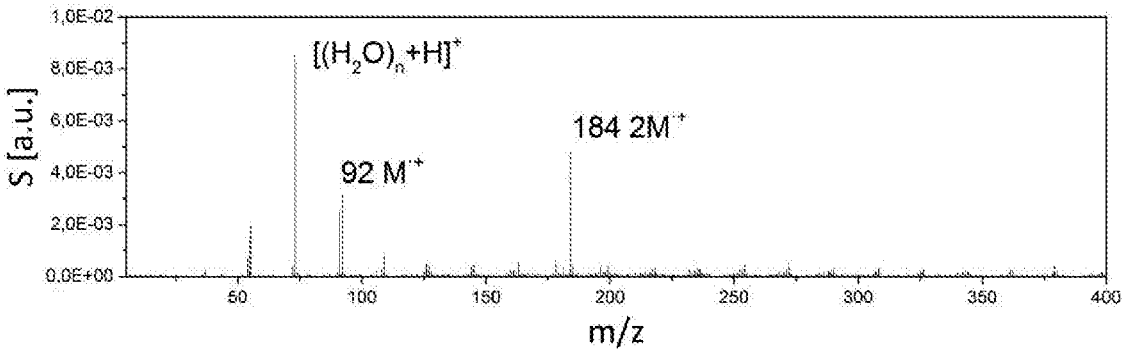
FIG. 2B shows a mass spectrogram determined by means of the analysis device illustrated in FIG. 1A.

FIG. 2A depicts a mass spectrogram determined with of the analysis device 100 explained with respect to FIG. 1A, for a mixture of air with n-Butanol as analyte. FIG. 2B depicts a mass spectrogram determined with the analysis device 100 explained with respect to FIG. 1A, for a mixture of air with toluol as the analyte. For both measurements, 1 mL of the analyte used was distributed upstream of the inlet 5 of the mass spectrometer. Consequently, the ambient air is enriched with analyte molecules which then may be ionized using interaction with the reactive species specified above with respect to FIG. 2B and FIG. 2C.

In the case of n-Butanol as airborne analytes, both protonated and ammoniated ions may be detected.

The spectrogram for toluol as analytes yields the typical signals for the development of radical cations.

Figure 3A:
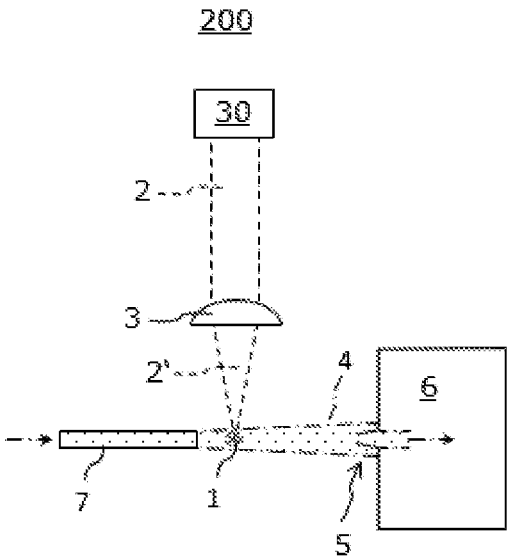
FIG. 3A is a schematic illustration of an analysis device for gaseous samples according to an embodiment.

FIG. 3A is a schematic representation of an analysis device 200 for gaseous samples. The analysis device 200 is similar to the analysis device 100 explained above with respect to FIG. 1A, but also has a gas supply for the gaseous sample. In the direction of the flow 4, the gas supply is arranged upstream of the inlet 5.

In the exemplary embodiment, the gas supply has a pressure pump (not shown) and a fluid channel 7 which is implemented as a glass capillary and is supplied by the pressure pump. With the gas supply, defined quantities of gaseous samples may be supplied to the plasma production region (1) arranged between the gas supply (more precisely, the fluid channel 7) and the inlet 5.

Figure 3B:
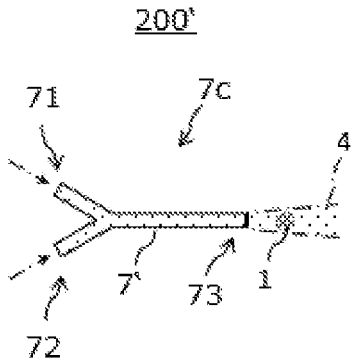
FIG. 3B is a schematic illustration of an analysis device for gaseous samples according to an embodiment.
Figure 3D:
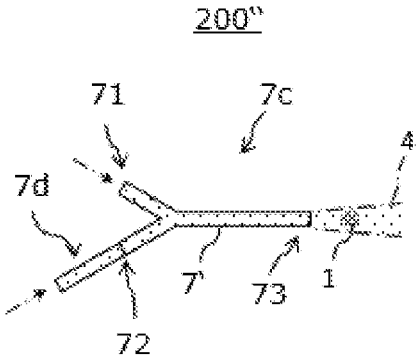
FIG. 3D is a schematic illustration of an analysis device for gaseous samples according to an embodiment.
Figure 3C:
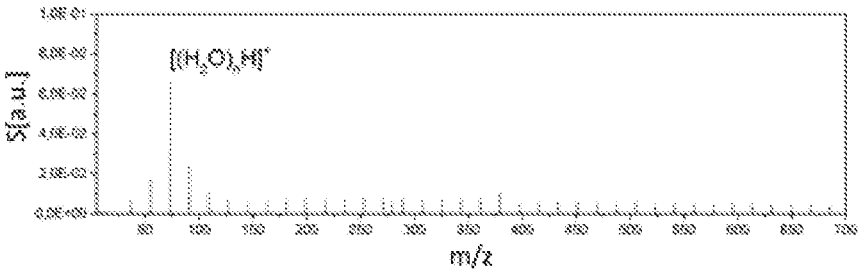
FIG. 3C depicts a mass spectrogram determined by means of the analysis device illustrated in FIG. 3A.

FIG. 3C depicts a mass spectrogram determined with the analysis device 200 for ambient air (without added analytes) that was supplied to the plasma production region at a rate of 2 L/min.

The signal pattern obtained with the mass spectrometer 6 is comparable to that in FIG. 1B. The spectrogram illustrated in FIG. 3C is dominated by protonated water clusters, while the ammonia-water clusters, as well as O2+ have lower signal intensities S. No development of new, additional reactive species (e.g. NO+, NO2+, NO3+) is found.

For the examined gases (compressed air, N2, Ar), an increase in the signal intensities was found when the gas supply was used, and the strongest of these increases was found for compressed air.

FIG. 3B is a schematic illustration of an analysis device 200' for gaseous samples. The analysis device 200' is similar to the analysis device 200 explained with respect to FIG. 3A. However, instead of a simple fluid channel, a mixing cell 7*c* is provided for the analysis device 200'. For space reasons, the laser irradiation unit and the mass spectrometer of the analysis device 200' are not shown in FIG. 3B.

In the exemplary embodiment, the mixing cell 7*c* is substantially Y-shaped. The mixing cell 7*c* has a first inlet 71 for the gaseous sample and a second inlet 72 for a process gas, which lead Y-shaped into a mixing channel 7' that forms an outlet 73 for a mixed gas formed from the gaseous sample and the process gas upstream of the plasma generation area (region). The mixing cell 7*c* may be made from glass, e.g. may be formed from glass capillaries.

In order to be able to produce easily adjustable gas mixtures, a first pressure pump (not shown) for pumping the gaseous sample through the first inlet 71 and a second pressure pump (not shown) for pumping the process gas through the second inlet 72 may be provided.

In addition, it may be provided that the process gas is supplied to the second inlet 72 of the mixing cell 7*c* via a heating cell for the process gas, an electrical discharge cell, or a combined heating-discharge cell schematically illustrated at 7*d* (FIG. 3D).

Figure 4A:
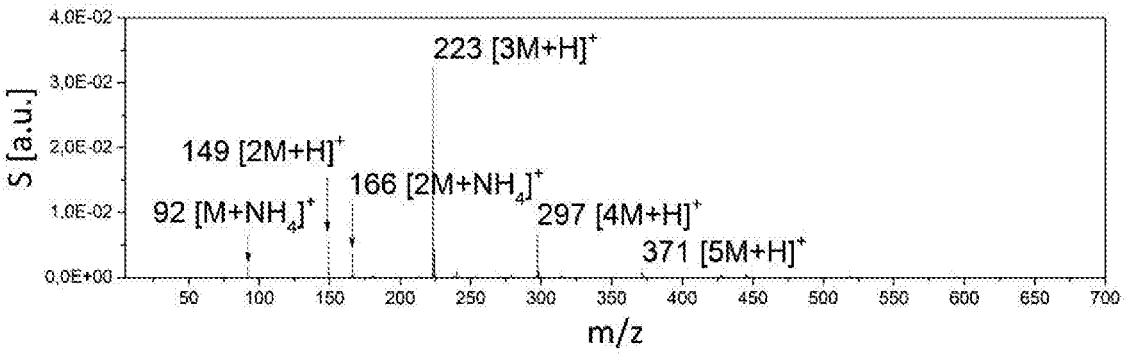
FIG. 4A depicts a mass spectrogram determined by means of the analysis device illustrated in FIG. 3A.
Figure 4B:
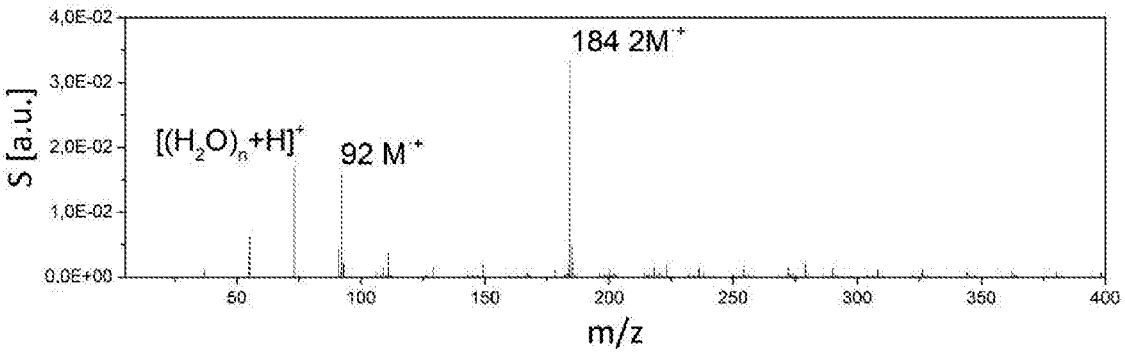
FIG. 4B depicts a mass spectrogram determined by means of the analysis device illustrated in FIG. 3A.

FIG. 4A depicts a mass spectrogram determined with the analysis device 200 explained with respect to FIG. 3A for a mixture of air with n-Butanol as the analyte. FIG. 4B depicts a mass spectrogram determined with the analysis device 200 explained with respect to FIG. 3A for a mixture of air and toluol. However, in both measurements 2 mL of the respective analytes were added to a closed flask through which an air flow is conducted. The air flow is able to carry analyte molecules with it and is then transferred through the fluid channel 7 to the plasma generation region and finally into the mass spectrometer 6. In this embodiment, air forms the carrier gas for the gaseous sample.

In both cases, signal amplifications for the specific analyte signals are detected. Analogous to the background spectrogram (see FIG. 1B and FIG. 1C), in the n-Butanol spectrogram of FIG. 4A protonated ions are preferably detected Ammonium clusters still develop, but with lower signal intensity. As may be seen from FIG. 4B, radical cations are detected again for toluol, at higher intensity in this case, as well.

Figure 5:
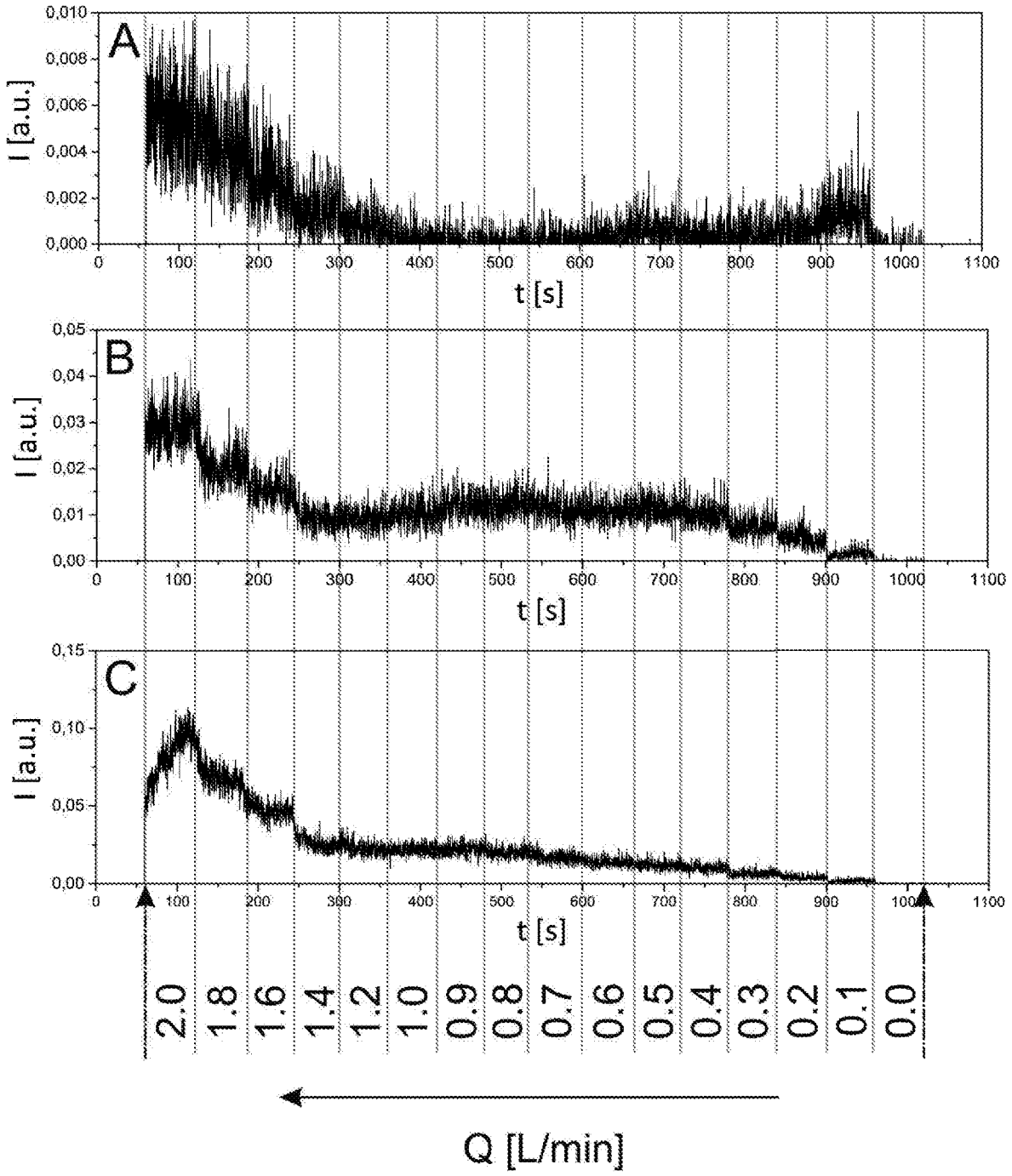
FIG. 5 illustrates (ion) mass chromatograms determined by means of the analysis device illustrated in FIG. 3A.

FIG. 5 depicts mass chronograms for gaseous samples, with n-Butanol as analytes, that were determined by means of the analysis device 200 explained with respect to FIG. 3A. n-Butanol was added to a closed flask through which a gas flow was conducted. The gas flow was a flow of Ar (FIG. 5A at top of the page), nitrogen (FIG. 5B in the center of the page), and compressed air (FIG. 5C at the bottom of the page). The respective gas flow is able to carry analyte molecules with it. The gaseous sample formed was then transferred through the fluid channel 7 to the plasma generation region and finally into the mass spectrometer.

(Ion) Mass chronograms for the protonated n-Butanol trimer are shown. The number I of the ions detected per time t is given in relative units.

The flow rate Q of the gas flow was varied at intervals of 60 seconds each. The laser produces plasmas in the flowing gaseous sample only in the time range marked by the arrows.

The measurement began at a flow rate of 2 L/min, but without ignited plasma (laser off). No ions were detected. Starting at t=60 s, the plasma was ignited with the laser and the analyte was detected immediately thereafter. An increase in signal was also detected here as a function of the selected carrier gas (greatest for compressed air, least for Ar). The number of the extracted analyte ions drops again as the flow rate Q decreases.

Figure 6A:
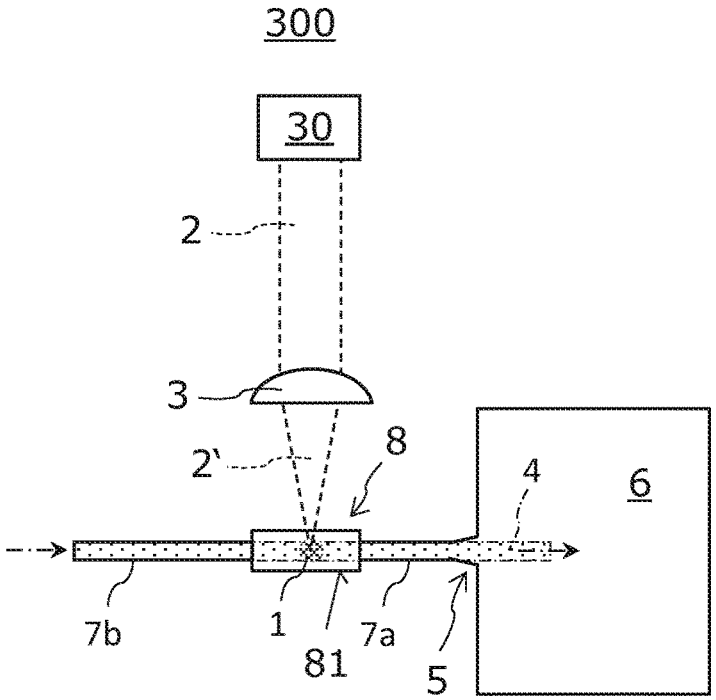
FIG. 6A is a schematic illustration of an analysis device for gaseous samples according to an embodiment.

FIG. 6A is a schematic illustration of an analysis device 300 for gaseous samples. The analysis device 300 is similar to the analysis device 200 explained above with respect to FIG. 3A and also has a gas supply 7*b*. The gas supply 7*b* may be implemented similar to the gas sup-ply 7 for the analysis device 200 explained above, but leads (opens) into a plasma cell 8 in which the plasma may be ignited by the laser beam.

In this exemplary embodiment, the plasma 1 is during operation ignited by the laser 30, not in a free gas flow, but in a gas flow 4 that flows through a chamber that is radially delimited in the direction perpendicular to the flow direction (arrows), e.g. by a tubular wall 81 of the plasma cell 8, typically a glass wall.

Thus, the plasma generation region that may be irradiated with the focused laser beam 1' is delimited by the plasma cell 8 in radial directions of the gas flow 4.

This structure may both be used to further increase the analyte signals for the molecule mass spectrometry and to increase the decomposition of the analyte into (elementary) ions by the targeted use of an excited carrier gas and may thus be used for element mass spectrometry.

In addition, a fluidic connection 7*a* is provided between the plasma cell 8 and the inlet 5 to connect them. Using the fluidic connection 7*a*, it is possible to at least largely prevent losses in the plasma-treated gaseous sample, and thus to improve the resolution limits of the analysis device 300 for analytes. The fluidic connection 7*a* may be, e.g. a tube connection or a glass capillary.

Figure 6B:
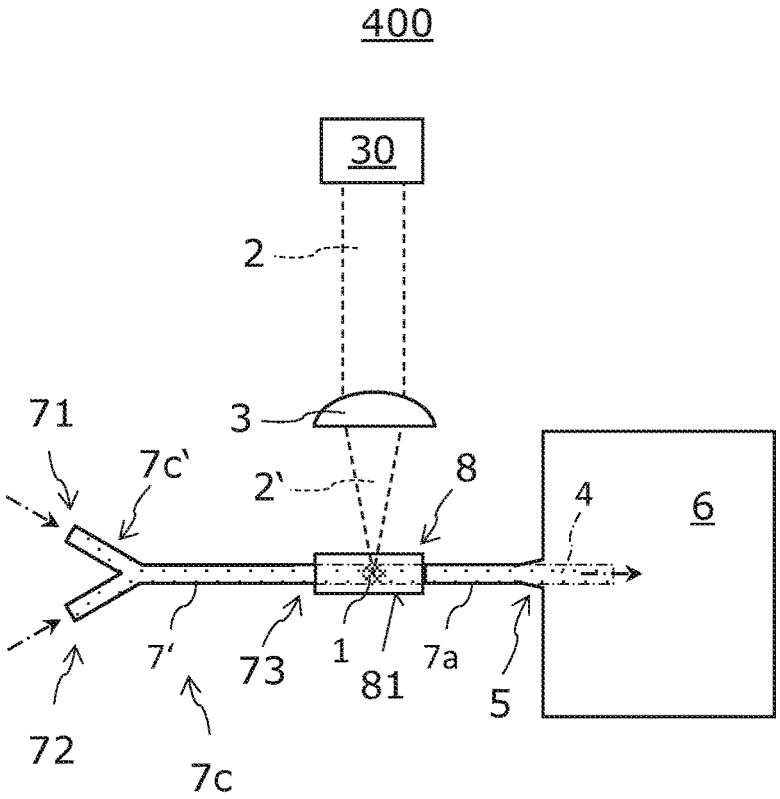
FIG. 6B is a schematic illustration of an analysis device for gaseous samples according to an embodiment.

FIG. 6B is a schematic illustration of an analysis device 400 for gaseous samples. The analysis device 400 is similar to the analysis device 300 explained above with respect to FIG. 6A, but with a mixing cell 7*c* as described above with respect to FIG. 3B and having outlet 73 of which leads into the plasma chamber 8.

Figure 7A:
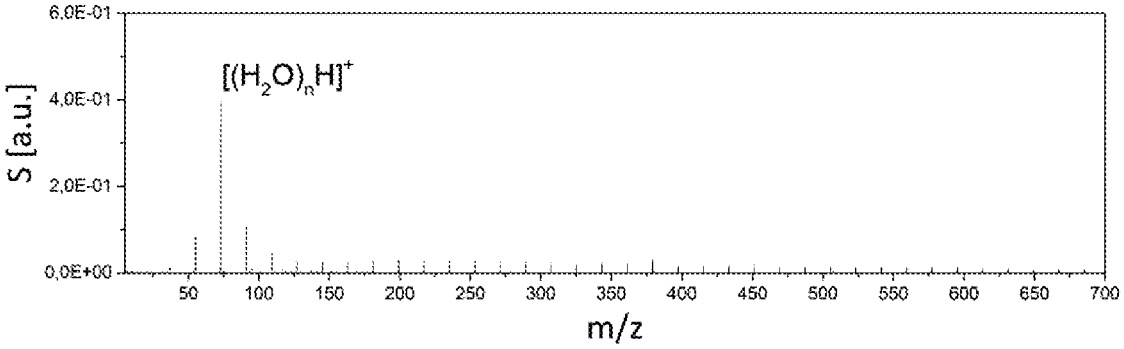
FIG. 7A depicts a mass spectrogram determined by means of the analysis device illustrated in FIG. 6A.

FIG. 7A depicts a mass spectrogram determined with the analysis device 300 explained with respect to FIG. 6A, for compressed air (without added analytes) supplied at a pump rate of 2 L/min.

Compared to FIG. 3C, even greater signal amplification may be achieved by using the plasma chamber 8. The composition of the reactive species again remains unchanged.

Figure 7B:
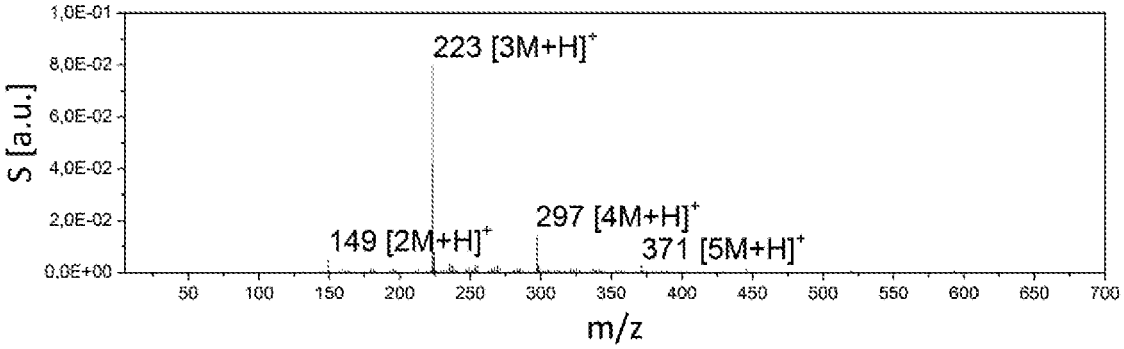
FIG. 7B depicts a mass spectrogram determined by means of the analysis device illustrated in FIG. 6B.

FIG. 7B depicts a mass spectrogram, determined with the analysis device 300 explained with respect to FIG. 6A, for a gaseous sample supplied at a pump rate of 2 L/min with air as carrier gas and n-Butanol as analytes.

It was also possible to detect higher measurement signals for this gaseous sample than for measurements without a plasma chamber (see FIG. 2A and FIG. 4A).

Figure 8A:
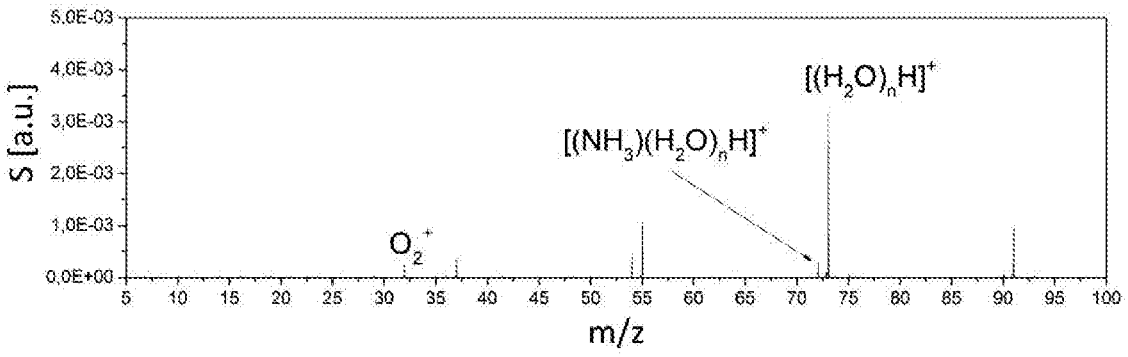
FIG. 8A depicts a mass spectrogram determined by means of the analysis device in illustrated FIG. 3B.
Figure 8B:
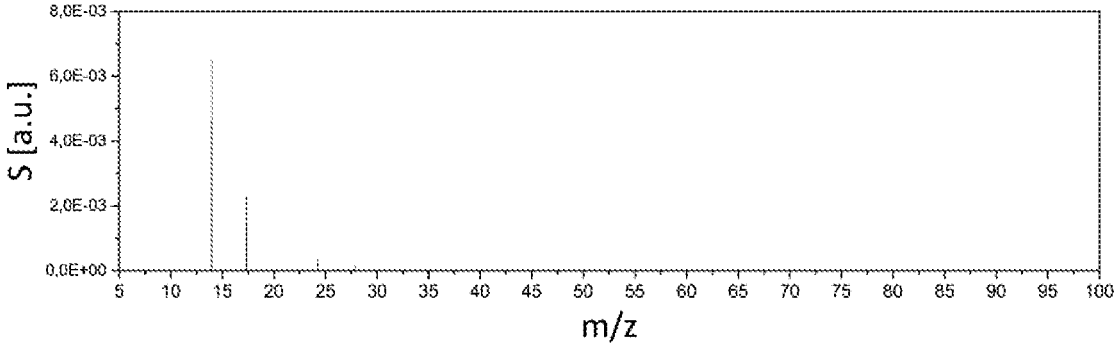
FIG. 8B depicts a mass spectrogram determined by means of the analysis device illustrated in FIG. 3B.

With reference to FIGS. 8A, 8B, the influence of (electronic) excitation of the supplied process gas on the expected signal pattern in the spectrogram is explained.

FIG. 8A depicts a mass spectrograph for air determined by means of the analysis device explained with respect to FIG. 3B, and FIG. 8B depicts a mass spectrograph determined by means of the analysis device 200' explained with respect to FIG. 3B, wherein helium excited electronically via a discharge cell is mixed in with the air in the mixing cell.

FIG. 8A shows the typically known signal behavior in the mass spectrogram of ambient air. In particular, the formation of the expected protonated water clusters, ammonium-water clusters and the O2+ ions can be observed.

As can be seen from FIG. 8B, the species detected in FIG. 8A are no longer detected when electronically excited helium is added. Instead, signals are detected in the lower mass range for e.g. (m/z=14) N+, (m/z=16) 0+, (m/z=28) N2+.

When using the combination of an excited carrier gas (He) and the plasma ignited therein, atomization and subsequent ionization of analytes may be detected for element mass spectrometry with the flow and laser parameters used. Consequently, the nitrogen and oxygen molecules contained in the ambient air may be detected as N+ or O+ ions. Analogous behavior for other analytes is to be expected.

In the following, methods for analyzing gaseous samples are explained that can be carried out using the analysis devices explained above.

Figure 9A:
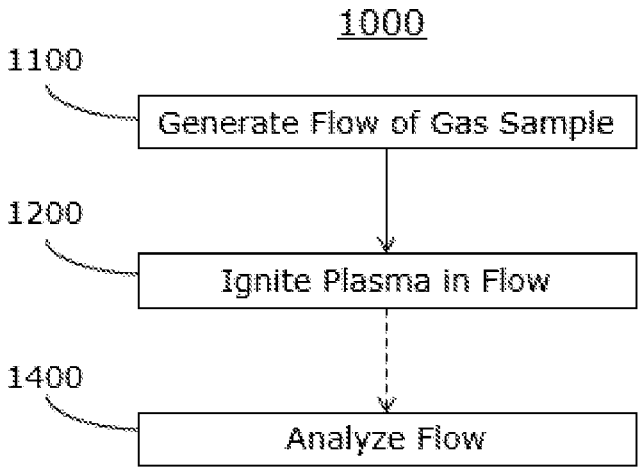
FIG. 9A depicts a flow chart for a method for analyzing a gaseous sample according to an embodiment; and, FIG. 9B is a flow chart of a method for analyzing a gaseous sample according to an embodiment.

FIG. 9A is a flow chart of a method 1000 for analyzing of gaseous samples.

In a block 1100, a flow of a gaseous sample leading into a mass spectrometer is generated.

Thereafter or with generating the flow, a plasma is ignited directly in the flow with a laser upstream of the mass spectrometer, in a block 1200.

For igniting the plasma, typically a focused laser beam is used, more typically a focused, pulsed laser beam, in particular at a pulse rate in a range of 50 Hz to 1 MHz. The pulse peak power of the laser beam is typically greater than 10 kW and may be, e.g., up to 1 MW.

The plasma may be generated in a free flow or in a plasma chamber through which the flow flows, wherein the flow is typically spaced apart from lateral walls of the plasma chamber. In directions perpendicular to the flow direction, the distance between the flow and the lateral walls of the plasma chamber is typically in a range from 2 mm to approximately 10 mm.

In addition, the plasma may be ignited in a carrier gas including the analytes or in a mixture of the carrier gas and an inert process gas.

Prior to the block 1200, the carrier gas may be mixed with an activated process gas.

Finally, in a block 1400, the laser-treated flow may be analyzed by mass spectroscopy, especially for ions produced by the plasma.

Figure 9B:
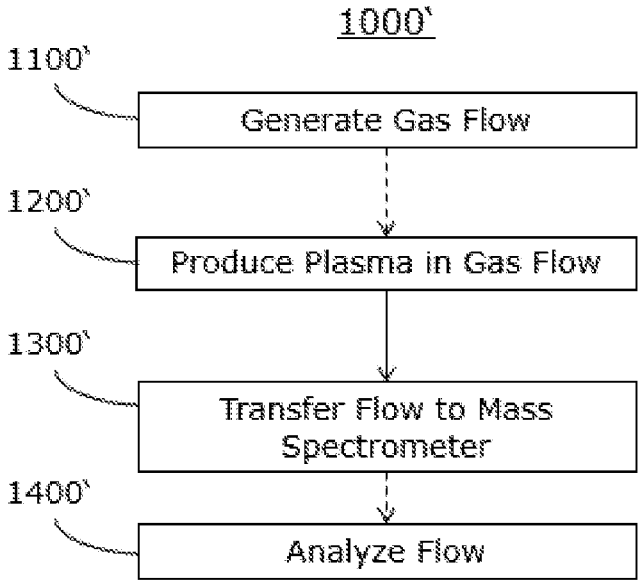

FIG. 9B is a flow chart of a method 1000' for analyzing gaseous samples.

Using a laser, a plasma is produced in a gas flow in a block 1200'. The plasma may be produced in the block 1200' as was described above for the block 1200.

Prior to block 1200', the gas flow presumably containing analytes can be generated in a block 1100'.

After generating the plasma in the gas flow, the gas flow can be transferred to a mass spectrometer in a block 1300'.

Finally, in a block 1400', the flow may be analyzed in the mass spectrometer and analytes present in the original gas flow may be detected.

With the methods described herein, gas-borne, in particular air-borne analytes in the form of molecules in the gas phase or in the form of liquid or solid particles as aerosols can be easily and reliably converted into elements. This conversion can take place under atmospheric pressure. The generation of element-ions can serve a downstream, mass spectrometric separation/detection for the qualitative and quantitative element determination of the analyzed analyte.

Atomization and/or ionization is accomplished using a laser-induced hot plasma that is ignited in the gas. Direct interaction of the laser with the analytes (molecules, aerosol particles) is not required. Since gas-borne analytes often move very quickly through the laser focus, these analytes cannot be detected by other techniques based on direct interaction if they pass through the focus volume between two laser pulses. With the methods and devices described herein, analytes present in gases can therefore be detected particularly sensitively.

Either element or molecule spectrometry for gaseous particles is made possible depending on parameters used (flow parameters, laser parameters).

The laser-induced plasma has a hot core, which can be at least partially shielded for analytes due to interactions with the ambient air and the formation of shock waves.

On the edge of the plasma, formed reactive species (e.g., protonated water clusters, ammonium-water clusters, O2+ ions) can cause ionization of an analyte due to an interaction with the analyte.

If the analyte does not reach the hot core of the plasma, typically no atomization of the analytes and subsequent ionization occurs, but an ionization suitable for molecule spectrometry may take place.

When using a thermally and/or electronically excited carrier gas flow (which may e,g, be achieved by mixing an excited process gas with the gaseous sample or even by exciting the gaseous sample), with the laser parameters used (wavelength: $\lambda$=532 nm, repetition rate: 26 kHz, mean power: 15 W, pulse width: 6 ns) there was enough energy present in the system to break the bonds in the molecules in the flow so that atomization takes place and corresponding ionization of these atoms occurs. The resulting ions may be analyzed in the mass spectrometer (element spectrometry).

According to one embodiment, an analysis device includes a mass spectrometer having a measurement chamber and an inlet leading into the measurement chamber, a device for generating a flow of a gaseous sample through the inlet into the measurement chamber, and a laser irradiation unit, wherein the laser irradiation unit is configured to ignite with a laser beam in the flow upstream of the inlet a plasma for at least partially ionizing the gaseous sample.

The device for generating the flow may be provided, at least in part, by the mass spectrometer and/or may include one or two external pressure pumps.

The present invention was explained using exemplary embodiments. These exemplary embodiments shall not be construed to be limiting for the present invention. The following claims represent an initial, non-binding attempt to define the invention in general.

The invention claimed is:

1. An analysis device for a gaseous sample comprising:

a mass spectrometer having a measurement chamber and an inlet leading into the measurement chamber;

a gas supply comprising a mixing cell comprising a first inlet for the gaseous sample, a second inlet for a process gas, and an outlet for a mixed gas formed from the gaseous sample and the process gas; and a laser irradiation unit, wherein the analysis device is configured to convey the gaseous sample to the inlet of the mass spectrometer by means of a flow comprising the gaseous sample, and wherein the laser irradiation unit is designed to ignite a plasma with a laser beam in the flow upstream of the inlet of the mass spectrometer to ionize the gaseous sample, at least in part, and wherein the gas supply is arranged in a direction of the flow upstream of the inlet of the mass spectrometer.

2. The analysis device according to claim 1, wherein the laser irradiation unit has a laser and/or a focusing optical unit, wherein the laser irradiation unit is configured to ignite the plasma in a carrier gas of the gaseous sample, wherein the laser irradiation unit is configured to ignite the plasma in a mixture of the carrier gas and a process gas, and/or wherein the gaseous sample with the carrier gas comprises mixed gaseous analytes and/or aerosol particles dispersed in the carrier gas.

3. The analysis device according to claim 1, wherein the laser beam is a pulsed laser beam, in particular having a pulse rate that is in a range from 50 Hz to 1 MHz, and/or wherein the laser beam has a pulse peak power of at least 10 kW.

4. The analysis device according to claim 1, wherein the gas supply comprises a fluid channel.

5. The analysis device according to claim 4, wherein the gas supply comprises a first pressure pump for pumping the gaseous sample through the fluid channel or the first inlet.

6. The analysis device according to claim 4, further comprising:

a plasma cell fluidically connected to the gas supply and the inlet, wherein the laser irradiation unit can couple and/or focus the laser beam into an inner chamber of the plasma cell, wherein the plasma cell has, in a radial direction which is perpendicular to the direction of the flow, a larger inner diameter than the mixing cell, wherein the flow can flow through the plasma cell such that the flow is spaced apart in the radial directions from a wall of the plasma cell, wherein the wall is tubular, and/or wherein the wall comprises glass.

7. The analysis device according to claim 1, further comprising:

a plasma cell fluidically connected to the gas supply and the inlet, wherein the laser irradiation unit can couple and/or focus the laser beam into an inner chamber of the plasma cell, wherein the plasma cell has, in a radial direction which is perpendicular to the direction of the flow, a larger inner diameter than the mixing cell, wherein the flow can flow through the plasma cell such that the flow is spaced apart in the radial directions from a wall of the plasma cell, wherein the wall is tubular, and/or wherein the wall comprises glass.

8. The analysis device according to claim 1, wherein the inlet of the mass spectrometer is a nozzle, wherein an inner cross-section of the inlet of the mass spectrometer increases at least in sections towards the measurement chamber, wherein the mass spectrometer is a time-of-flight mass spectrometer, wherein the mass spectrometer has a suction pump fluidically connected to the measurement chamber, and/or wherein the mass spectrometer is configured to suck the gaseous sample through the inlet into the measurement chamber, and/or to change a flow rate of the flow.

9. The analysis device according to claim 1, wherein the gas supply comprises a second pressure pump for pumping the process gas through the second inlet.

10. The analysis device according to claim 1, further comprising:

a heating cell, for the process gas, the heating cell being arranged upstream of the mixing cell.

11. The analysis device according to claim 1, further comprising:

a discharge cell, for the process gas, the discharge cell being arranged upstream of the mixing cell.

12. A method for analyzing a gaseous sample, comprising:

producing a flow that comprises the gaseous sample and that leads into a mass spectrometer; and igniting a plasma in the flow with a laser beam; and mixing the gaseous sample with a process gas prior to igniting the plasma.

13. The method according to claim 12, further comprising thermal and/or electronic excitation of the process gas prior to the mixing.

14. The method according to claim 12, after the igniting of the plasma further comprising:

analyzing the flow in the mass spectrometer; and/or detecting an analyte.

15. The method according to claim 12, wherein the temperature of the plasma is greater than 1000° K.

16. The method according to claim 12, wherein the gaseous sample comprises a carrier gas and an analyte, wherein the analyte is dispersed in the carrier gas, wherein the analyte is mixed with the carrier gas, wherein the plasma is ignited in the carrier gas, a process gas, and/or a mixture of the carrier gas and the process gas, wherein the plasma is ignited upstream of an inlet of the mass spectrometer, wherein the plasma is ignited in a plasma cell through which the flow flows and that is fluidically connected to the inlet, and/or wherein the plasma is ignited with the laser beam repetitively and/or in a contactless manner.

17. The method according to claim 16, wherein the plasma causes at least partial atomization and/or at least partial ionization of the analyte and/or atoms formed during the atomization.

* * * * *